US005609529A

United States Patent [19]

Brown

[11] Patent Number: 5,609,529

[45] Date of Patent: Mar. 11, 1997

[54] GOLF TRAINING DEVICE

[76] Inventor: George M. Brown, 120 Platt Ave., Norwich, Conn. 06360

[21] Appl. No.: 549,245

[22] Filed: Oct. 27, 1995

[51] Int. Cl.[6] ..... A63B 69/36

[52] U.S. Cl. ..... 473/205; 473/267; 473/212; 2/161.4

[58] Field of Search ..... 273/DIG. 30; 473/205, 473/212, 267; 2/161.4

[56] References Cited

U.S. PATENT DOCUMENTS 3,273,891 9/1966 Grim ..... 273/DIG. 30
3,847,110 11/1974 Inoue ..... 273/DIG. 30

*Primary Examiner*—George J. Marlo
*Attorney, Agent, or Firm*—McCormick, Paulding & Huber

[57] ABSTRACT

The golf training device fits onto a golf glove at a location where the golfer can look at its mirrored surface to see the head of his golf club at address. The device has a wedge shape to permit rotation of the device and thereby vary the angle of reflection afforded on its mirrored top surface. This provides the golfer with a consistent view of the golf club head at address provided that he uses a consistent grip on the club shaft with his gloved hand.

4 Claims, 5 Drawing Sheets

GOLF TRAINING DEVICE

FIELD OF THE INVENTION

This invention relates generally to training devices to assist a golfer in perfecting his golf swing, and deals more particularly with a training device adapted for use on the golfer's glove and designed to aid the golfer at address in assuming consistent hand and golf club orientations prior to the golf swing itself.

DESCRIPTION OF THE PRIOR ART

Devices for attachment to a golf glove that afford assistance in assuming a proper grip and/or a proper swing are known. See for example U.S. Pat. No. 5,152,532 and U.S. Pat. No. 5,184,353. The '532 patent provides for a projecting post on the back of the glove so that the post can be aligned with the intended direction of flight of the ball at address and prior to striking the ball.

U.S. Pat. No. 5,184,353 shows a series of indicia provided on the back of the glove so that the golfer can readily assume a predetermined hand position when a golf club is gripped.

U.S. Pat. Nos. 4,257,607 and 3,762,719 illustrate golf swing training devices or guides also adapted for use on the back of the gloved hand of the golfer. In the '607 patent a generally triangular pointer is provided for releasable attachment to the golf glove in much the same manner as the above described '532 patent provides a post for the same purpose.

In the '719 patent a cylindrical plug is provided on the back of the glove that is designed to project upwardly from the back of the golfer's hand so as to appear to the viewer as being a two-dimensional rather than a three-dimensional body.

Other patents relate to providing reflective surfaces on gloves generally, but are not designed for use as golf training devices. Among such patents are the following: U.S. Pat. Nos. 468,149, 1,612,055 and 4,863,239. The latter patent, U.S. Pat. No. 4,863,239, discloses a rear view safety mirror which would be utilized in connection with operating a vehicle such a bicycle for example.

SUMMARY OF THE INVENTION

The general purpose and object of the present invention is to provide a golf training device that includes a reflective mirror secured to a wedge shaped plug, which plug can be releasably secured to the back of the golfer's glove to allow the golfer to rotate the plug into a position where at address, he grips the club, looks into the mirrored surface and observes the club head itself.

Thus, the present invention meets a need not even recognized in the prior art references described above. More particularly, the present invention not only affords a convenient check for the golfer of his hand position on the golf club grip at address but also allows the golfer to check his golf club head position at address, both of the above being accomplished with a single glance at the training device of the present invention properly positioned on the back of his golf glove generally between the thumb and forefinger of his gloved hand.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF FIGS. 1–10

Figure 8:
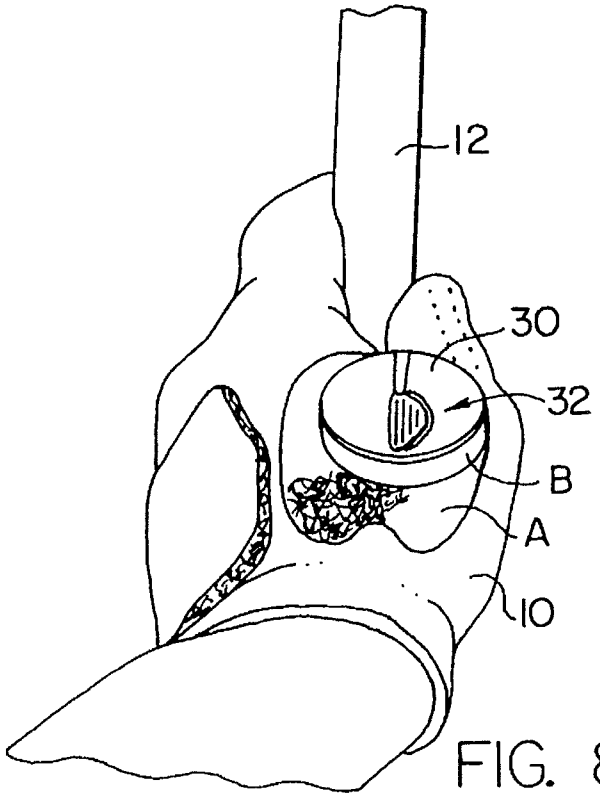
FIG. 8 is a view of the device of the present invention secured to a golf club on the hand of a wearer who has gripped the club in his left hand and prior to gripping the club with his right hand.

Referring now to the drawings in greater detail, FIG. 8 shows a gloved left hand 10 gripping the handle end of a golf club 12 prior to the right hand being used to grip the golf club adjacent to the left in preparing to assume the address position normally assembled by golfers prior to striking the ball.

Figure 9:
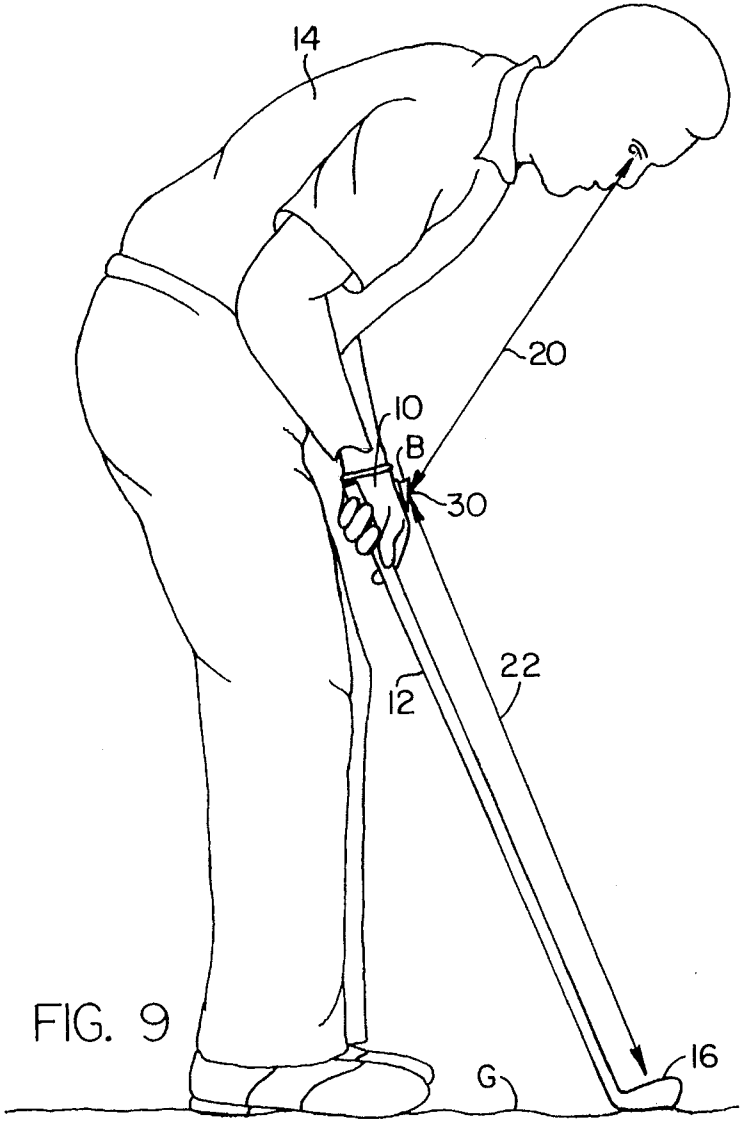
FIG. 9 is a view of the golfer and golf club to illustrate the location for a device of the present invention and the path of the light rays to and from the head of the club in the golfer's eyes.

In accordance with the present invention the golfer 14 in FIG. 9 places both hands on the upper or handle end of the golf club while the club head 16 is placed on or adjacent to ground G behind the golf ball (not shown).

In accordance with the present invention the golfer is able to look down at his left hand, as indicated generally by the arrow 20, onto a mirrored surface to be described later, which surface is oriented and located on his left hand as suggested in FIG. 8 to reveal the club head itself. Arrow 22 shows the image of the club head as it would appear in the mirrored surface of a device constructed in accordance with the present invention.

FIG. 8 shows a mirrored surface 30 into which the golfer looks to see a reverse image of his club head. This image is indicated generally at 32 in FIG. 8.

Figure 5:
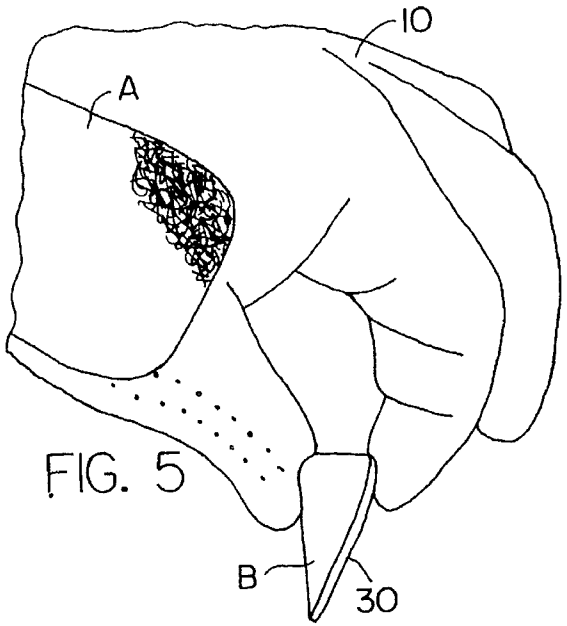
FIG. 5 is a view of the wedge shaped device of the present invention held between thumb and forefinger of the user.
Figure 6:
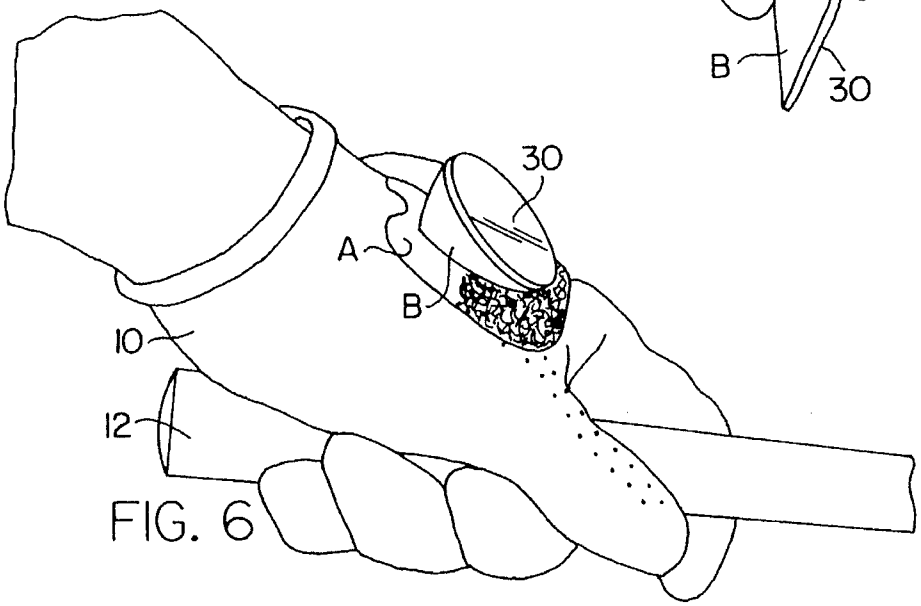
FIG. 6 is a view of the golfer's left hand at address with the wedge shaped device applied to the velcro base of FIG. 4.
Figure 4:
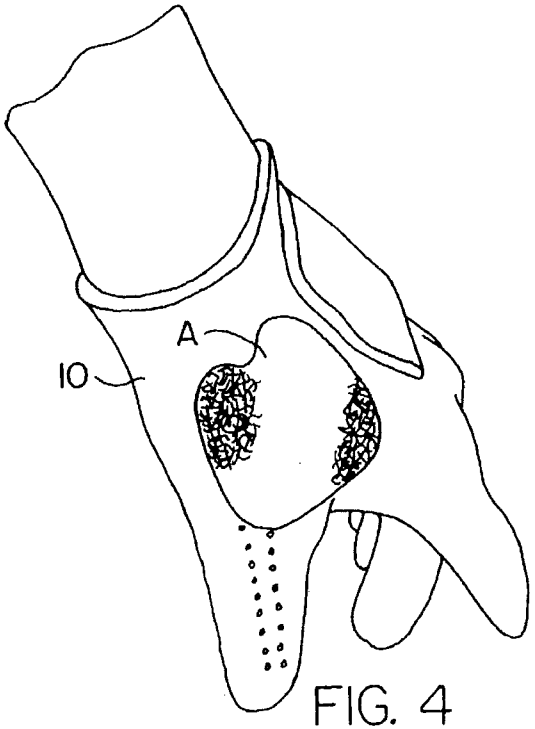
FIG. 4 is a perspective view of a golf club fitted with a pad of velcro in accordance with the present invention, the velcro being located between the forefinger and thumb of the left hand of this right handed golfer.

Turning now to FIGS. 4, 5 and 6 the gloved left hand of the golfer is shown as fitted with a velcro loop pad A located generally between the thumb and forefinger of the left handed glove shown. FIG. 5 shows the golfer picking up a wedge shaped training device B that has a top surface which is mirrored so as to reflect the image of the golf club head as described previously. The bottom surface of the wedge B is provided with velcro hooks in order to provide a detachable mounting of the device B on the pad A of FIG. 4.

Figure 10:
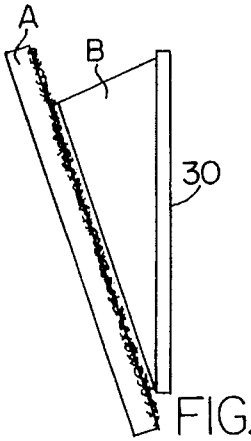
FIG. 10 is a view of the device of the present invention as it is shown in FIG. 9 but drawn to a larger scale.

FIG. 6 shows the device being mounted on the pad A of the golfer's gloved left hand, and also shows the golfer in the process of gripping the golf club handle. As shown, the device B is preferably circular in planform and readily adapted to be rotated to a proper angle for achieving the angular reflection ideally suited for use by the golfer as suggested in FIG. 9, that is, to reveal the image of the golf club head as described above. FIG. 10 shows the wedge shaped device B in greater detail mounted by the velcro hooks and loops associated with the pad A and the rear surface of the wedge shaped device B as described above.

Figure 3:
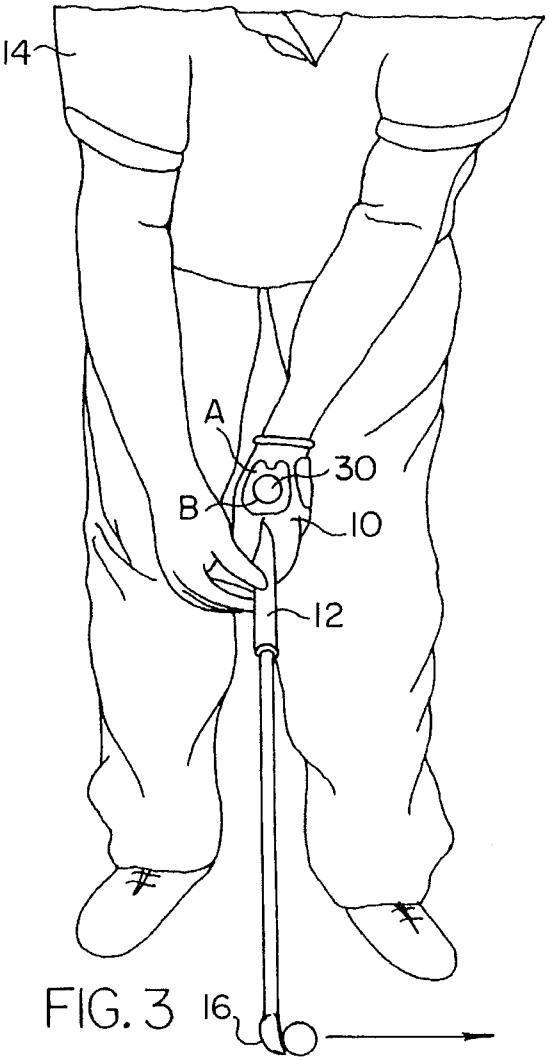
FIG. 3 shows the golfer assuming the addressed position, and in the process of rotating the golf club shaft to properly align the club head, prior to taking a firm grip of the club with the left hand.
Figure 7:
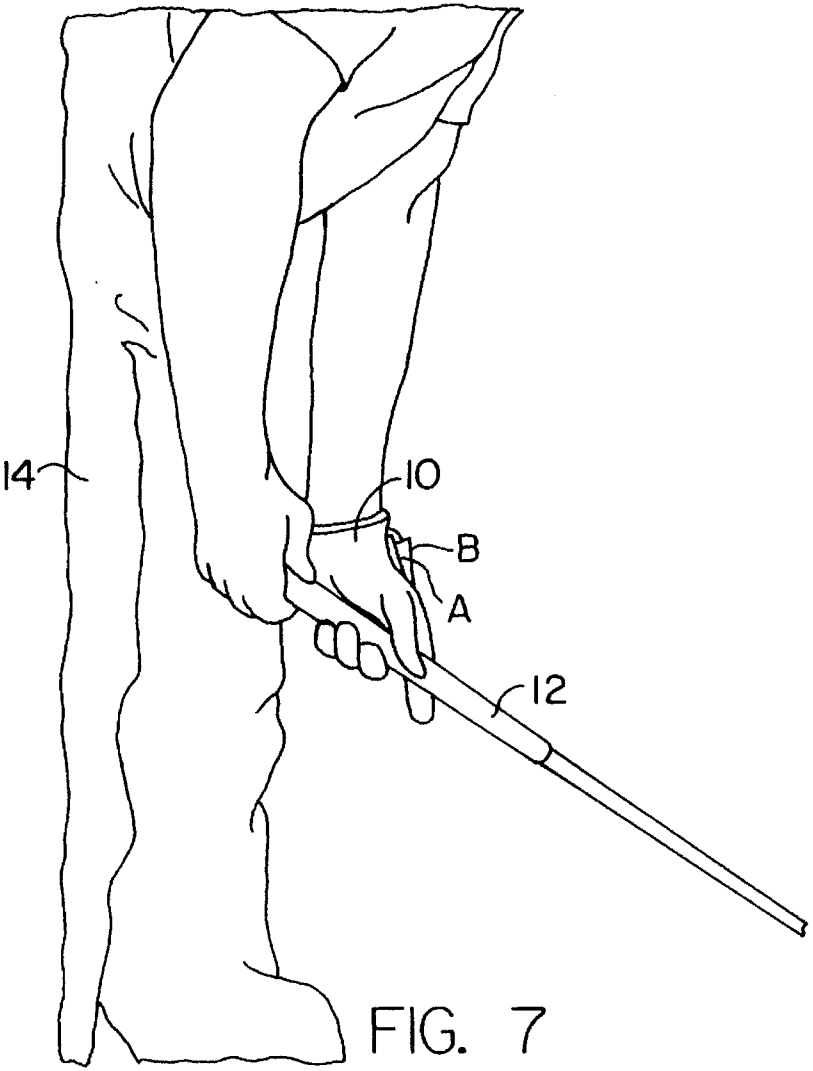
FIG. 7 is a view similar to FIG. 3 but taken from a slightly different vantage point.

In order to properly utilize the device of the present invention the golfer grasps the golf club in his left hand as suggested in FIGS. 3 and 7 with a proper grip, that is so as to provide the V between the thumb and forefinger of the left hand as shown. He then rotates the club with his right hand as suggested in FIGS. 3 and 7 until he sees in the mirrored surface 30 of the device B (an image albeit reversed) of the club head all as described previously with reference to FIG. 8.

Figure 2:
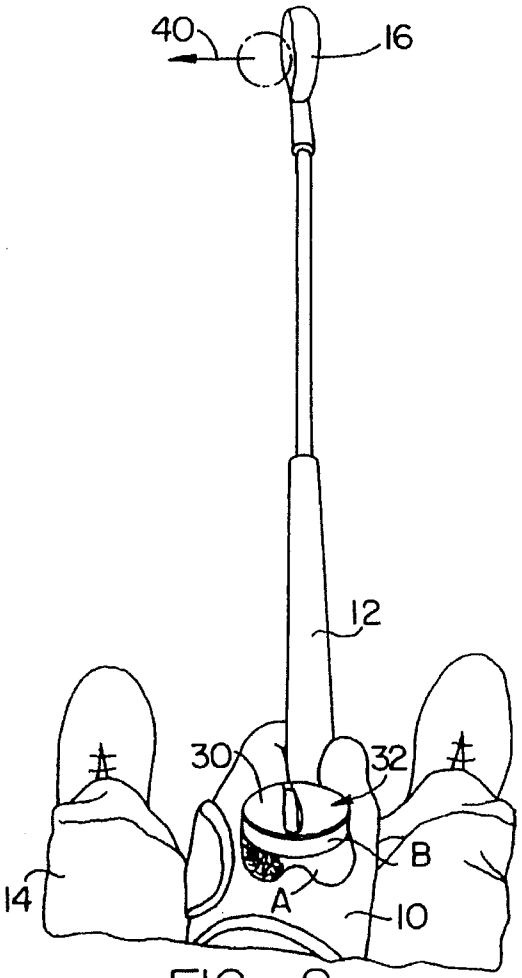
FIG. 2 is a view similar to FIG. 1 with the golfer holding a golf iron rather than a golf "Wood".
Figure 1:
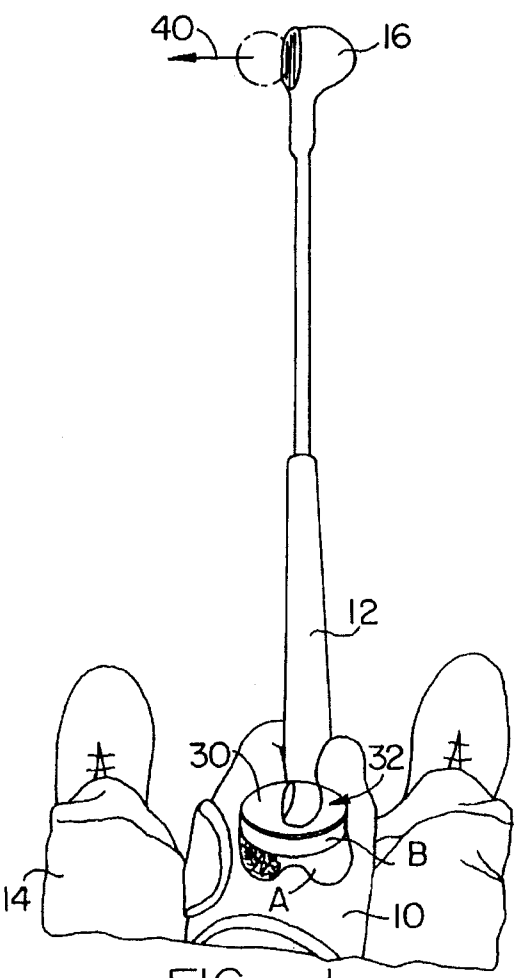
FIG. 1 illustrates the view afforded the golfer at address when looking at a device of the present invention properly installed on the back of his glove.

FIGS. 1 and 2 show the club head as seen by the golfer when only the gloved left hand of the golfer has been properly positioned on the club, and when the club has been properly rotated in that hand so that the image of the club head is aligned with the intended line of flight of the ball as indicated generally by the arrow 40 in FIGS. 1 and 2. FIG. 1 shows a "wood" type golf club being properly positioned in the golfer's hands for a consistent address position and hence improved golf swing. FIG. 2 is a similar view illustrating an "iron" type golf club being held by the golfer. Note that the images seen by the golfer are inverted as a result of the reflected image of the golf head in these views 1 and 2.

DETAILED DESCRIPTION OF FIGS. 11–14

Figure 11:
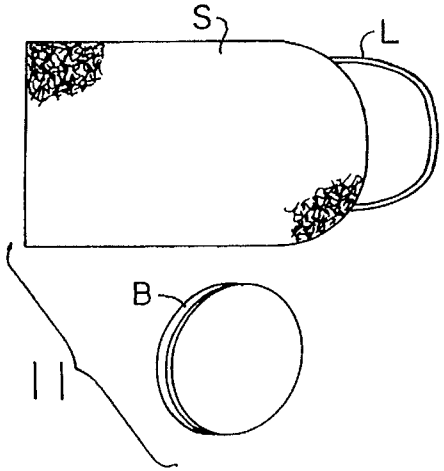
FIG. 11 is a plan view of two components illustrating an alternative version of the invention adapted for use with a conventional golf glove having velcro fasteners to strap the glove to the golfer's hand.

FIG. 11 shows an alternative version of the present invention where the stitching of a velcro pad to a golf club is not required. Instead, the golfer is able to utilize a conventional golf glove with a conventional velcro type strap fastener such as that illustrated in FIG. 12, 13 and 14 together with certain components of an alternative version of the invention illustrated in FIG. 11.

Figure 12:
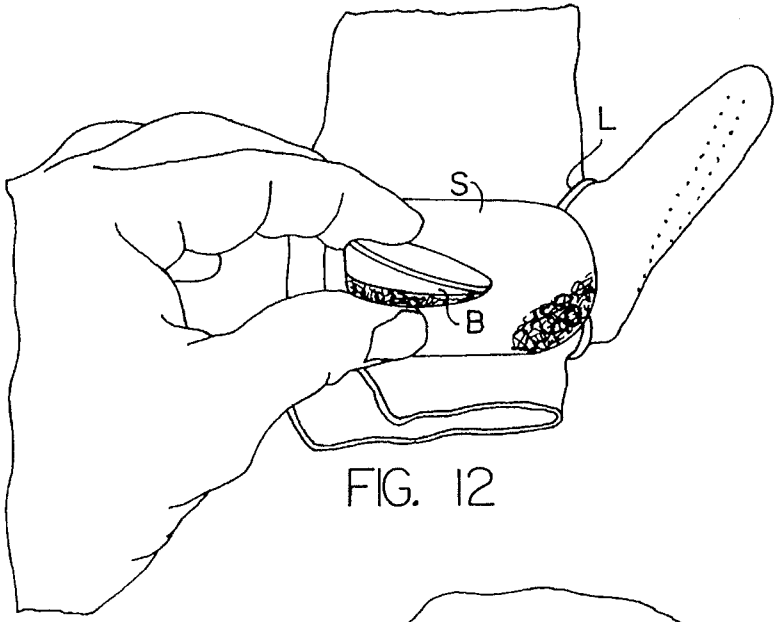
FIG. 12 is a perspective view showing one of the components of FIG. 11 secured to the glove, and the second component in the process of being attached to that component.
Figure 14:
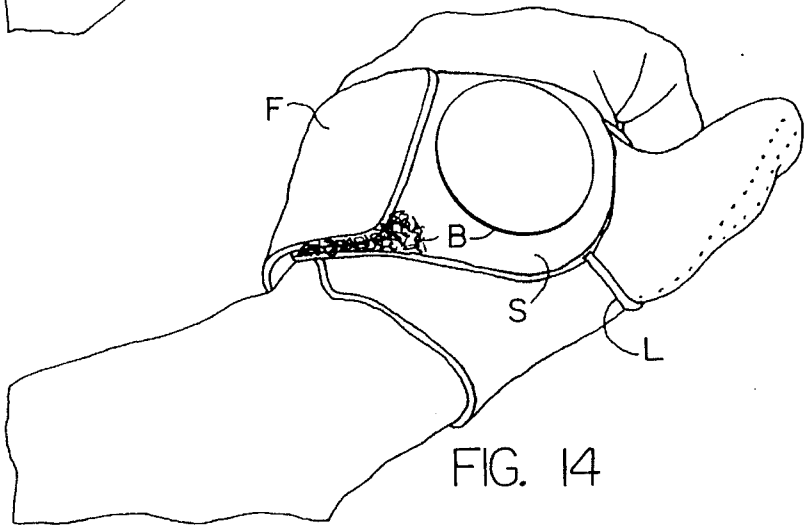
FIG. 14 illustrates the golf glove strap secured to the components of the present invention to provide a resulting combination of elements not unlike that depicted in FIGS. 1–10 of the first embodiment.
Figure 13:
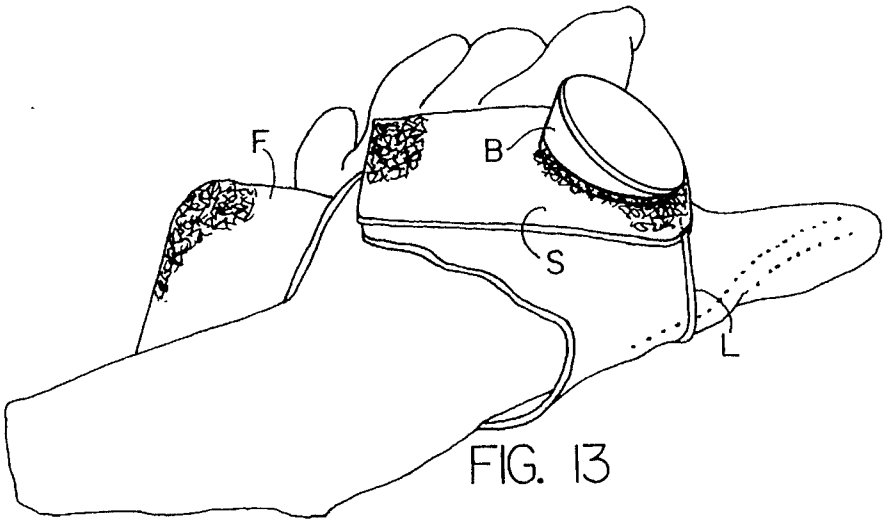
FIG. 13 illustrates the two components is assembled relationship with a conventional golf glove.

The wedge shape training vice B is identical to that described previously with reference to FIGS. 1–10. However, in place of the velcro pad A stitched to the golf glove of the FIG. 1–10 embodiment, FIG. 11 shows a strip S having oppositely configured velcro fastener material provided on opposite sides thereof and having a loop L which is adapted to encircle the golfer's thumb when inserted in the golf glove as best shown in FIGS. 12, 13 and 14. It will be apparent that the golf glove of FIGS. 12, 13 and 14 comprises a conventional golf glove similar in every respect to that shown in the version of FIGS. 1–10 except for the stitched on pad A which is utilized in the above-described first embodiment of the invention to releasably receive the training device B.

In use, the strap S of the present invention may be applied to the glove as shown in FIG. 12, or the glove may first be provided on the hand of the golfer as shown in FIG. 13. In any event, the strap S is provided in the position shown for it in these views to in turn provide a surface for releasably receiving the training device B. Once placed on the golf glove, the strap S of the present invention affords on the one hand a way to releasably secure that strap to the golf glove and more particularly, to that portion of the golf glove which would normally receive the conventional golf glove flap portion indicated generally at F in FIG. 13. Thus, the strap S affords a convenient equivalent to the velcro pad A of the FIG. 1–10 version to allow the golfer to place the wedge shaped training device B thereon as shown in FIGS. 12 and 13. After appropriately attaching the wedge shaped training device D, the golfer can then take the flap F of the golf glove and use it to secure the strap S in position on his gloved hand as best shown in FIG. 14. The training device A can then be rotated as described previously with reference to the version shown in FIGS. 1–10 in order to realize the advantages of the present invention. In summary, the golfer addresses the ball with his gloved hand on the club using his right hand to rotate the training device B into position where he is able to see the head of the golf club in the mirrored surface thereof. With his left hand on the golf club in proper address position he is assured of a consistent hand position, all as described previously with reference to the embodiment shown and described in FIGS. 1–10 hereof. In assuming address positions, subsequently the golfer's left hand at addressees assumes a proper position with the v between the thumb and the forefinger provided in the manner described previously and the golf club rotated until the head comes into view in the mirrored surface at address. Thus, a consistent "address" position for the golfer's club and hands are assured.

What is claimed is:

1. A golf training device for use on a golfer's glove hand to aid the golfer at address in assuming a consistent hand and golf club orientation, said device comprising:

a golf glove of the type having a first component of a hook and loop combination fastener on the back of the golf glove and having a first strap containing the second component of a hook and loop combination fastener such that the golf glove can be fitted to the golfer's hand, a second strap having a loop for encircling the thumb of the golfer's glove hand, said strap having a first component of a hook and loop combination fastener material on its top surface, and adapted to be secured to the glove by said first strap on said glove, a wedge shaped plug having top and bottom surfaces, a reflective mirror secured to said top surface of said wedge, and said bottom surface including the second component of a hook and loop combination fastener being releasably secured to said first component on said top surface of said second strap whereby said second strap can be secured to said golf glove in conjunction with the first strap on the golf glove, and whereby said wedge and mirror can be rotated in order to achieve a desired angle of reflection as between the mirror, the eye of the golfer, and the head of the golf club at address.

2. The golf training device of claim 1, wherein said wedge shaped plug is generally circular in cross section as is the mirror attached thereto, whereby to facilitate rotating the wedge and mirror relative to the surface upon which it is supported facilitate the alignment of the club head at address as set forth above.

3. A golf training device for use with a golfer's glove to aid the golfer at address in assuming a consistent hand and golf club orientation, said device comprising:

a golf glove having a back side with an area of the glove generally between the thumb and forefinger of the glove, a first component of a hook and loop combination fastener material secured to the said glove area between the thumb and the forefinger, a wedge shaped plug having top and bottom surfaces, a reflective mirror secured to said top surface of said wedge, and said bottom surface including the second component of a hook and loop fastener material being releasably secured to said first component on said glove area whereby said wedge and mirror can be rotated to achieve a desired angle of reflection as between the mirror, the eye of the golfer, and the head of the golf club at address.

4. The golf training device of claim 3, wherein said wedge shaped plug is generally circular in cross section as is the mirror attached thereto, whereby to facilitate rotating the wedge and the mirror relative to the surface upon which it is supported to facilitate the alignment of the club head at address as set forth above.

* * * * *